US007059235B2

(12) United States Patent
Hanslick et al.

(10) Patent No.: US 7,059,235 B2
(45) Date of Patent: Jun. 13, 2006

(54) ADJUSTABLE MUZZLE STABILIZER FOR REPEATING FIREARM

(76) Inventors: Paul J. Hanslick, P.O. Box 40187, Austin, TX (US) 78704; Thomas D. Adams, 12741 Tomlinson Dr. SE., Albuquerque, NM (US) 87123-3715; James Barry Hohlfeld, P.O. Box 309, Pecos, NM (US) 87552

( * ) Notice: Subject to any disclaimer, the term of this patent is extended or adjusted under 35 U.S.C. 154(b) by 0 days.

(21) Appl. No.: 10/645,983

(22) Filed: Aug. 22, 2003

(65) Prior Publication Data

US 2005/0188829 A1 Sep. 1, 2005

Related U.S. Application Data

(60) Provisional application No. 60/411,964, filed on Sep. 19, 2002.

(51) Int. Cl.
*F41A 21/38* (2006.01)

(52) U.S. Cl. ..... 89/14.3

(58) Field of Classification Search ..... 89/14.3
See application file for complete search history.

(56) References Cited

U.S. PATENT DOCUMENTS

| | | | | | |
|---|---|---|---|---|---|
| 2,153,246 | A | | 4/1939 | Gibson | 42/79 |
| 2,165,457 | A | | 7/1939 | Cutts | 89/14.3 |
| 2,206,568 | A | * | 7/1940 | Hughes | 89/14.3 |
| 2,499,428 | A | * | 3/1950 | Belle | 89/14.3 |
| 4,635,528 | A | | 1/1987 | McQueen | 89/14.3 |
| 4,813,333 | A | * | 3/1989 | Garris et al. | 89/14.3 |
| 4,869,151 | A | * | 9/1989 | Chahin | 89/14.3 |
| 4,879,942 | A | * | 11/1989 | Cave | 89/14.3 |
| 5,020,416 | A | * | 6/1991 | Tripp | 89/14.3 |
| 5,279,200 | A | * | 1/1994 | Rose | 89/14.3 |
| 5,698,810 | A | * | 12/1997 | Rose | 89/14.3 |
| 6,308,609 | B1 | * | 10/2001 | Davies | 89/14.4 |

FOREIGN PATENT DOCUMENTS

| | | | | |
|---|---|---|---|---|
| DE | 214226 | | 10/1909 | |
| DE | 9207484 | | 9/1992 | |
| EP | 0070612 A2 | | 1/1983 | |
| GB | 483793 | * | 4/1938 | 89/14.3 |
| WO | WO 85/00215 | * | 1/1985 | 89/14.3 |
| WO | WO 86/02438 | * | 4/1986 | 89/14.3 |

* cited by examiner

*Primary Examiner*—Stephen M. Johnson
(74) *Attorney, Agent, or Firm*—Drinker Biddle & Reath LLP

(57) ABSTRACT

A muzzle stabilizer for a repeating firearm is described. The muzzle stabilizer includes a tubular body having two or more gas vents for venting gas in an average direction that exerts a corrective force for counterbalancing muzzle climb during periods of repeating discharges. An attachment flange, which has a coupler adapted to mate with a corresponding coupler on the end of the muzzle of the firearm, is disposed at a first end of the tubular body. A gas regulator is engaged with a second end of the tubular body for adjusting the venting of gas through at least one of the gas vents. The gas vents can include a plurality of ninety-degree vents of graduated sizes radially arranged about the tubular body. The muzzle stabilizer can include a multistage expansion chamber through which high pressure and temperature gas expands before it is vented through the gas vents.

10 Claims, 5 Drawing Sheets

ADJUSTABLE MUZZLE STABILIZER FOR REPEATING FIREARM

CROSS-REFERENCE TO RELATED APPLICATION

The present application claims priority from U.S. Provisional Application No. 60/411,964, filed Sep. 19, 2002, which is incorporated herein by reference in its entirety.

FIELD OF THE INVENTION

The invention relates to repeating firearms, and particularly to a device for stabilizing rapid-fire automatically repeating firearms.

BACKGROUND OF THE INVENTION

Rapid-fire firearms came into common use at the beginning of this century. The firearms used recoil or gas siphoned from the discharged round to do the work of cycling the loading mechanism of the firearm. Initially, these firearms were heavy, crew-serviced firearms such as Maxim and Browning belt-fed machineguns. The crew-serviced machineguns were soon followed by lighter, individual-use firearms, such as the Thompson sub-machinegun. In the case of shoulder-fired firearms, operators noticed significant "climb" when discharging the firearm. In response, devices were developed to attach to the muzzle of a firearm to compensate for climb. The nomenclature for this family of devices is muzzle compensators, or more commonly muzzle brakes.

An early muzzle brake was the Cutts Compensator, which is described in U.S. Pat. No. 2,165,457. The Cutts device consisted of a tubular muzzle attachment that had several rows of horizontal slots cut across its top surface and a partially occluded end cap on its front surface. As the high-pressure gases, behind the discharged bullet, exited the bore of the firearm, they would seek the path of least resistance, and flow through the compensator's rows of slots. The flow created a downward impulse at the muzzle of the firearm. The venting of gases was thus used to do constructive work. The Cutts device represented a limited improvement in muzzle control over a "naked" muzzle.

The second half of the twentieth century brought the advent of the assault rifle. The sub-machinegun's high magazine capacity and automatic fire capability were mated with the high-powered cartridges of the rifle. The combination proved to be a very powerful and flexible tool for the operator. The higher power ammunition of this family of firearms, however, makes them more difficult to control than the earlier machineguns during rapid or automatic fire. The advent of the machine pistol also added to the problem of lighter weapons mated with higher power cartridges.

Muzzle climb, in the form of both lateral deviation and vertical climb, became a significant contribution to wasted ammunition expenditure because assault rifles and machine pistols climb off target even more quickly than earlier designs. When an operator discharges a firearm, captured high pressure gas, located behind the projectile, force the projectile along the bore of the firearm. The force generated by the expanding gas causes the projectile to accelerate until it exits the bore, and the gas dissipates in the open air. As the projectile physically exits the bore of the firearm, a point of equilibrium is established between the momentum of the forward moving projectile with expanding gas behind it, and the rearward momentum of the firearm itself, due to opposite but equal momentum within the system. The rearward impulse is known as recoil.

If the firearm is in a relatively balanced testing cradle, the recoil impulse will cause the firearm to move rearward in a fairly straight line. However, if a human operator is the basis of the firing platform, the original straight-line recoil impulse will be translated into distortions of the firing platform due to human body mechanics. In an offhand shooting position, the feet and legs represent the fixed end of a pendulum with a center of mass commonly two to three inches behind the navel. A momentary force is applied at the opposite end of the system causing a complex set of angular momentums. Due to these factors, the firearm muzzle is seen to climb vertically and also rotate around a vertical axis.

When the firearm operator is executing slow, aimed fire, the above recoil-related factors create a minimal impact upon the effectiveness of the operator, because the operator has the time to "reset" into the original firing position between discharges. However, as the firearm operator increases the number of recoil impulses per unit of time, the effectiveness of the operator correction diminishes.

Multiple recoil impulses in rapid succession effectively become a continuous torque on the system. The coincidence between the original point of aim and point of impact of subsequent rounds decreases as the number of recoil impulses increases. The greater number of rounds in the burst fired, the greater the variance between the point of aim and subsequent points of impact. At close distances of fifteen meters or less, muzzle climb may not be a significant problem for the firearm operator. However, at greater distance, this radical muzzle climb will greatly diminish the effectiveness of the operator.

Variations on the Cutts design, such as the M-16A2 solid bottom birdcage and the AK-47 wedge, were developed in an effort to solve the problem. However, none contributed significantly to the field. In fact, nearly half a century passed before the next significant development, which is described in U.S. Pat. No. 4,635,528 to McQueen. Like the Cutts device, the McQueen design consisted of a round tubular muzzle attachment with slots cut across the top surface, and a partially occluded front end cap. However, unlike the Cutts device, the front-end cap on the McQueen design was threaded, and adjustable for inward and outward movement within the body of the stabilizer. Though many existing firearm muzzle compensators could be adjusted for right-left horizontal/lateral roll, the McQueen design was adjustable for two axes with its introduction of the adjustable high-pressure gas flow regulator into the system. Although the flow of gas could be adjusted, the adjustment was relatively course. Thus, the McQueen device could not provide adequately fine adjustment for the magnitude of the corrective force. In addition, the McQueen design was limited to rifles utilizing cartridges of up to medium power. The design included a single-stage expansion chamber. When used with high power cartridges, a single-stage expansion unit can break apart or even detach from the end of the muzzle and become a projectile.

A related patent, U.S. Pat. No. 4,813,333 to Garris et al., addressed what may be considered "marketing" issues. Designers decreased the body length of the McQueen device to meet dimensional specifications demanded by customers. This modification created higher stresses on the anterior portions of the device. To compensate, the designers opened the angled gas vent and used holes instead of slots for the forward vertical vent. In this configuration, the device functioned, but did so less effectively than the McQueen design, and was restricted to use with low to medium powered cartridges.

None of the known muzzle stabilizers provide adequately fine adjustability of the magnitude of corrective force. In addition, the known devices fail to provide adequate stability for firearms using high-power rounds. Therefore, a need exists for a dually adjustable muzzle stabilizer with improved fineness of adjustability to provide adequate stability during rapid firing, even when high-power cartridges are used.

SUMMARY OF THE INVENTION

The invention relates to a dually adjustable muzzle stabilizer for a repeating firearm. The muzzle stabilizer includes a tubular body having two or more gas vents for venting gas in an average direction that exerts a corrective force for counterbalancing muzzle climb during periods of repeating discharges. An attachment flange, which has a coupler adapted to mate with a corresponding coupler on the end of the muzzle of the firearm, is connected to a first end of the tubular body. A gas regulator is threadedly engaged with a second end of the tubular body such that adjustment of the gas regulator adjusts the venting of gas through at least one of the gas vents. The threaded engagement of the gas regulator and the tubular body includes a fine thread pattern and a large number of index grooves that engage a spring detent to allow for fine incremental adjustment of the gas regulator.

The muzzle stabilizer can include a multistage expansion chamber through which high pressure and temperature gas continuously expand before it is vented through the gas vents. The gas vents can include a plurality of ninety-degree vents of graduated sizes radially arranged about the tubular body. The gas vents can further include a thirty-degree vent angled to guide expelled gas away from the user.

BRIEF DESCRIPTION OF THE DRAWINGS

For the purpose of illustrating the invention, there is shown in the drawings a form which is presently preferred; it being understood, that this invention is not limited to the precise arrangements and instrumentalities shown.

DETAILED DESCRIPTION OF THE DRAWINGS

Figure 1:
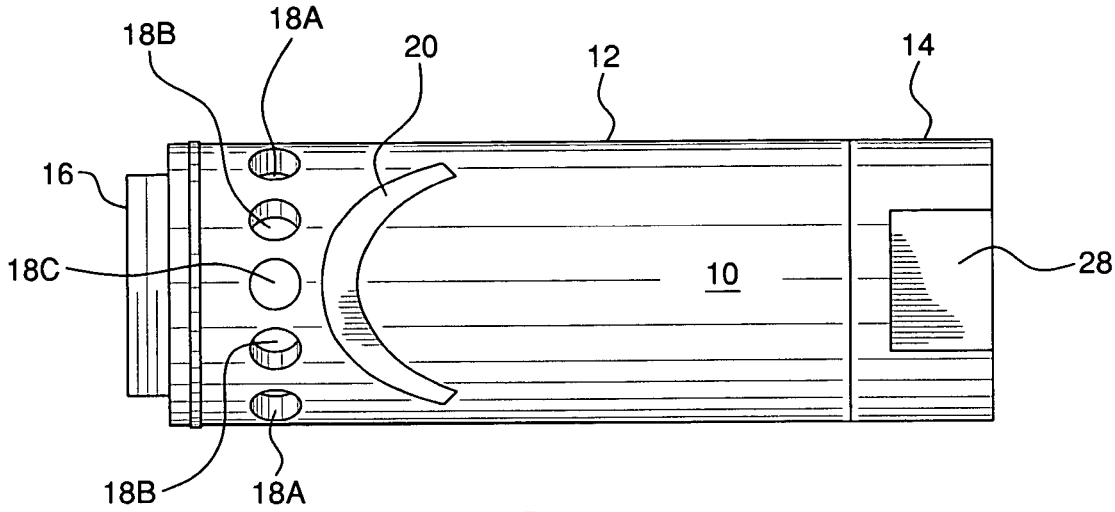
FIG. 1 is a top plan view of a muzzle stabilizer according to the present invention.
Figure 2:
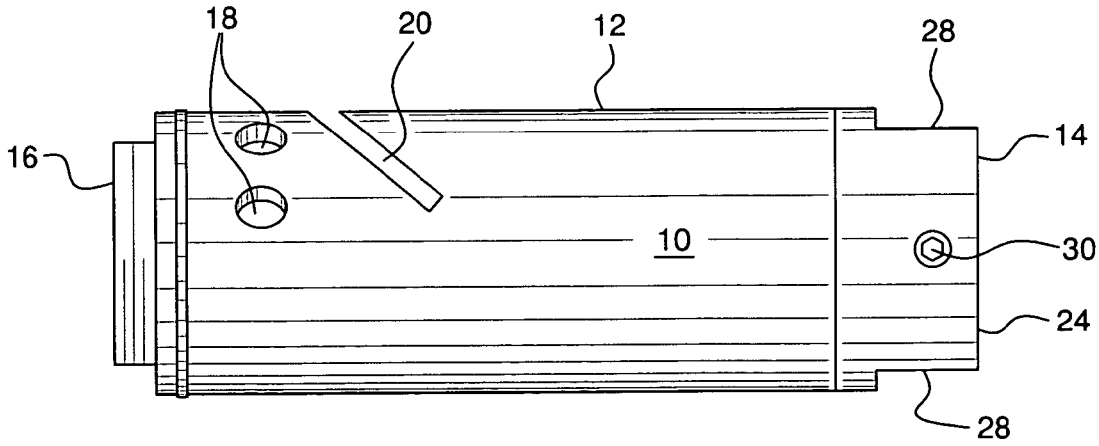
FIG. 2 is a left side elevation of the muzzle stabilizer of FIG. 1.

Referring now to the drawings, wherein like reference numerals illustrate like elements throughout the several views, a preferred embodiment of a muzzle stabilizer 10 is shown. The muzzle stabilizer 10 includes a tubular body 12, an attachment flange 14 and a gas regulator 16. The tubular body 12 is provided with a plurality of gas vents, including radially arranged ninety-degree vents 18 in the form of generally circular apertures proximate the gas regulator 16. The gas vents in the tubular body 12 further include a thirty-degree vent 20 in the form of a slot.

The tubular body 12, attachment flange 14 and gas regulator 16 can be made from 4130 chromium-molybdenum carbon steel. Once machined, the material can be heat treated using an argon gas heat shield. It is preferred that the treated material have a Rockwell C hardness of from 40 to 46, and more preferably 43 to 44. To further enhance service life of the muzzle stabilizer, the tubular body 12, attachment flange 14 and gas regulator 16 can be coated with tungsten diamond-like carbon, which is believed to improve corrosion resistance, increase the surface Rockwell hardness to about 80 to 85 and enhance thermal or flame resistance to about 2000 degrees F. The coating can be obtained commercially from Bodycote Metallurgical Coatings, Inc. of Greensboro, N.C.

It has been found that the function of the muzzle stabilizer 10, which will become clear from the description that follows, can be optimized by providing graduated ninety-degree vents. For example, a test model of the muzzle stabilizer 10, which was optimized for an AR-15/M-16 rifle, included outer ninety-degree vents 18A with diameters of 0.140 inches. The test model included inner ninety-degree vents 18B with diameters of 0.150 inches and a central ninety-degree vent 18C with a diameter of 0.156 inches. The center points of the ninety-degree vents of the test model are spaced thirty degrees apart around the body of the body 12. In the test model, the thirty-degree vent is a slot of width 0.062 inches cut into the body 12 at thirty degrees to an angled distance of 0.475 inches.

The test model will be described in detail with regard to several additional features of the present invention. Whenever so described, it should be understood that the specific dimensions and configuration of the test model are provided as an example of the present invention only. In no way are the specific dimensions and configuration of the test model intended to limit the scope of the present invention.

Figure 3:
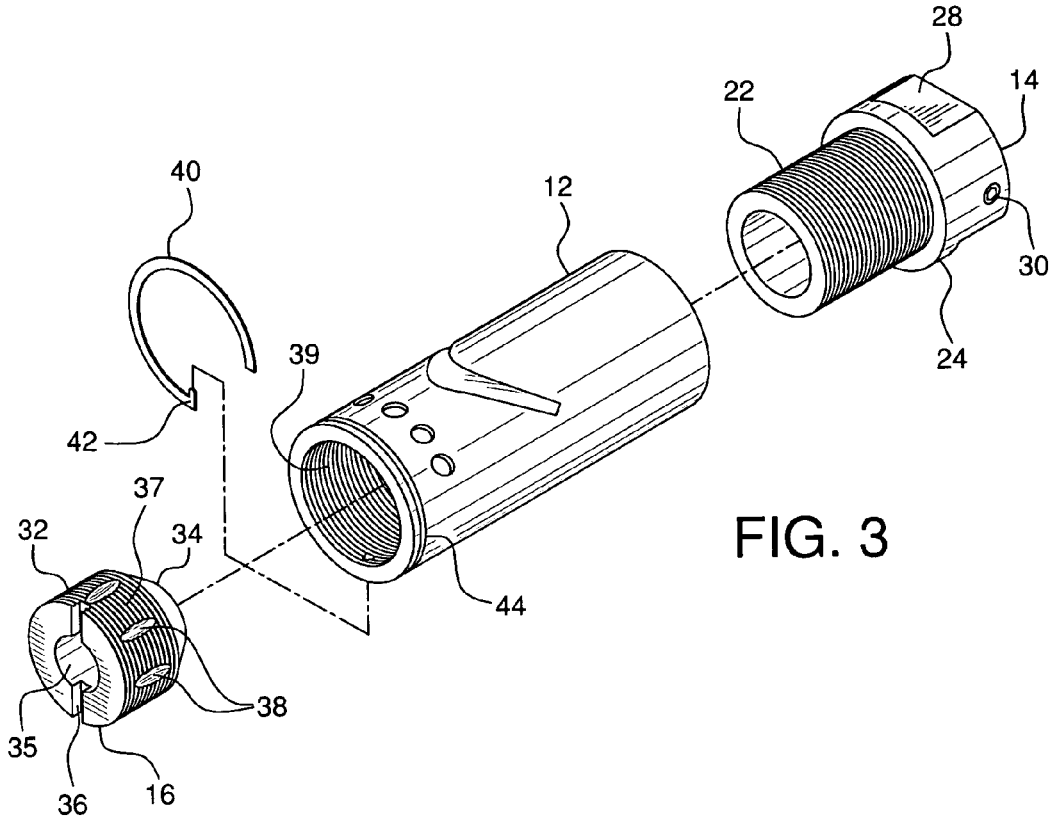
FIG. 3 is an exploded view of the muzzle stabilizer of FIG. 1.
Figure 4:
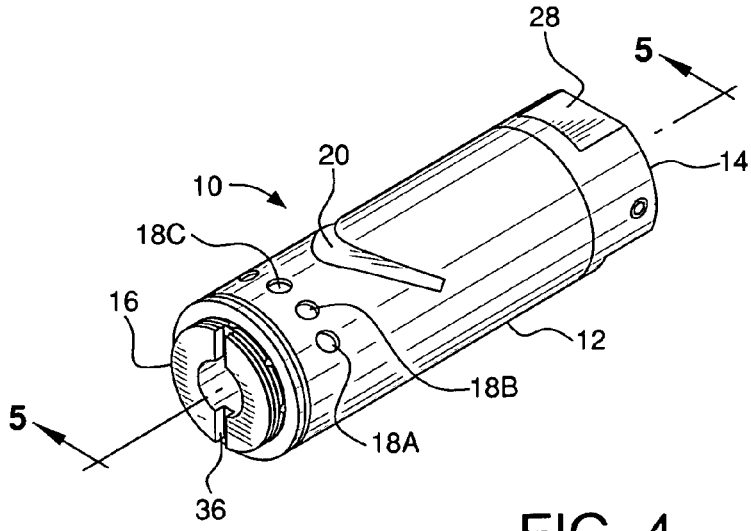
FIG. 4 is an isometric view of the muzzle stabilizer of FIG. 1.
Figure 5:
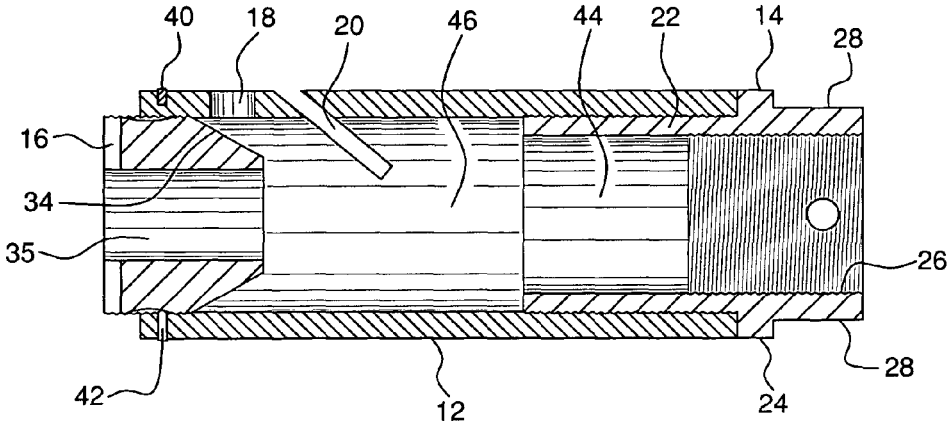
FIG. 5 is a longitudinal cross-sectional view taken through line 5—5 in FIG. 4.
Figure 6:
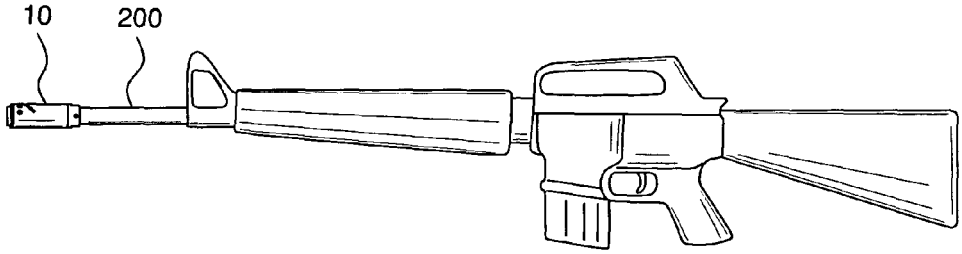
FIG. 6 is a side view of the muzzle stabilizer of FIG. 1 mounted on the muzzle of a repeating firearm.

As best shown in FIGS. 3 and 5, the attachment flange 14 includes an externally threaded barrel fitting 22 adapted to engage corresponding internal threads on the tubular body 12. The attachment flange 14 also includes an attaching collar 24 having an outer diameter that closely matches that of the tubular body 12. The attaching collar 24 is provided with a coupling in the form of internal threads 26 to mate with a coupling of external threads on the end of a firearm muzzle, as shown in FIG. 6. Because various firearms have muzzles of different diameters and threads of different patterns (i.e., fine or course threading), many variants of the attachment flange 14 can be produced. For firearms having coupling types other than threads, such as a bayonet base, clamp fitting or the like, the attaching collar 24 should instead be provided with the appropriate corresponding coupling. Each variant of the attachment flange 14 will have the same external threading on the barrel fitting 22 so that all variants can universally be fitted with the internal threads of the tubular body 12. However, each variant can have a unique internal diameter and/or thread pattern (or other appropriate coupler) in the attaching collar 24. Thus, each variant of the attachment flange 14 can be produced with a universal barrel fitting 22, yet an attaching collar 24 that is customized for one particular type of firearm muzzle.

The attaching collar 24 includes flats 28 on its outside surface for engaging an attaching or adjusting tool, such as a wrench. The flats 28 allow an adjusting tool to turn the attaching flange 14 (and the muzzle stabilizer 10) relative to the firearm muzzle when mating the internal threads 26 of the attaching collar 24 to the external threads of the muzzle. The attaching collar 24 can also be provided with an orifice for receiving a set screw 30 in order to lock the muzzle stabilizer in the desired position relative to the muzzle and prevent further rotational movement with respect thereto. As will be explained below, rotation of the muzzle stabilizer 10 relative to the firearm muzzle controls the direction of corrective force the stabilizer will impart on the muzzle when in use. This rotation is the first way a user can adjust the muzzle stabilizer 10.

It is also possible to make the tubular body 12 and attachment flange 14 of unitary construction by boring the appropriate diameters from a single tubular member. The unitary embodiment forfeits the advantage of interchangeable attachment flanges 14 for different firearms. However, the unitary embodiment may be less expensive to produce, and under some circumstances, may be desirable.

The gas regulator 16 includes an externally threaded cylindrical portion 32 and a conical portion 34. A discharge orifice 35 is provided through both portions of the gas regulator 16 to allow a discharging projectile to pass. The size of the discharge orifice 35 is selected based on the projectile to be discharged. Thus, interchangeable gas regulators having discharge orifices tailored to specific projectiles can be produced. Firearm manufacturers can provide the appropriate dimension for the discharge orifice 35 for any particular projectile.

The external threads 37 of the cylindrical portion 32 are fine threads adapted to mate with corresponding fine internal threads 39 in the body 12. To permit fine adjustment of the degree of insertion of the gas regulator 16 into the tubular body 12, the thread pattern should be greater than 24 threads per inch and preferably 28 or 32 threads per inch.

The outer face of the cylindrical portion 32 includes a driving slot 36 for turning the gas regulator 16 relative to the body 12. The external walls of the cylindrical portion 32 can be provided with circumferentially arranged index grooves 38, for example, a series of six or preferably eight index grooves equally spaced about the circumference of the cylinder wall. The index grooves 38 are adapted to engage a detent 42 on a spring clip 40, which mounts in a groove 44 formed in the body 12 such that the detent 42 protrudes through an orifice in the wall of the body 12. Thus, when eight index grooves 38 are provided, the spring detent 42 tends to engage and hold the gas regulator 16 in eight incremented positions per revolution. In combination with the fine thread pattern of the mating threads 37, 39, the large number of index grooves 38 provide very fine increments of adjustability for the insertion depth of the gas regulator 16 into the body 12. This represents the second way a user can adjust the muzzle stabilizer 10.

Referring now to FIG. 5, it can be seen that the assembled muzzle stabilizer 10 includes a multistage expansion chamber having stages that increase in diameter from the attachment flange 14 to the gas regulator 16. The internal diameter of the barrel fitting 22 of the attachment flange 14 defines a first expansion chamber stage 44. The internal diameter of the body 12 defines a second expansion chamber stage 46 of greater diameter than the first expansion chamber stage 44. It is preferred that the diameter of the second stage be at least 10 percent larger than the diameter of the first stage. The first and second stages 44, 46 collectively form a multi-stage expansion chamber. Excellent results have been obtained when the diameter of the second stage is about 25 percent larger than the diameter of the first stage.

In the test model noted above, the first expansion chamber stage 44 has a diameter of 0.500 inches and a length of 0.500 inches, this length being measured from the end of the internal threads 26 (where the end of the firearm muzzle should be) to the end of the barrel fitting 22 proximate the second expansion chamber stage 46. In practice, the length of the stage can vary slightly because the muzzle stabilizer 10 may not be screwed onto the threaded muzzle fully, since the rotational position of the muzzle stabilizer 10 will be dictated by the position of the gas vents (ninety-degree 18 and thirty-degree 20 vents) during the last rotation.

The second expansion chamber stage 46 of the test model has a diameter of 0.625 inches and an approximate length of 0.870 inches or more. The length is variable because the size of the second stage changes as the gas regulator 16 is screwed further into the body 12 or withdrawn therefrom. The approximate length is calculated from the following dimensions used to make the test model, all of which are in inches. The length of the body 12 is 2.100, with an outer diameter of 0.875, and an initial inner diameter is 0.625. The proximal end of the body 12 was counter bored to a diameter of 0.640 to a depth of 0.750, and counter bored again to a diameter of 0.689 to a depth of 0.115, in order to receive a 0.742 long barrel fitting 22 of the attachment flange 14. The distal end of the body 12 was counter bored 0.640 to a depth of 0.480 in order to receive a gas regulator 16 having a cylindrical portion length of 0.360 and a total length of 0.575, where the conical portion is tapered at 30 degrees. Thus, when the attachment flange 14 is threaded into place and the gas regulator 16 is approximately fully inserted, the remaining portion of the volume within the body 12, which represents the second stage 46, has a length of approximately 0.870 inches, into which the conical section 34 of the gas regulator can extend. It should be clear that the length of the second stage 46 depends on the degree of insertion of the gas regulator 16. Note that the counter bores are not critical to the invention and are not shown in the drawings.

As already noted, the test model is optimized for a AR-15/M-16 rifle, which can utilize a round of medium muzzle energy and powder load. The two-stage embodiment described above has been found to work well with medium muzzle energy and power load rounds, such as a 5.56 mm NATO or 7.62 mm×39 mm round. When discharging such rounds, a muzzle brake with a single stage expansion chamber would tend to create a sharp pressure peak. That is, if one graphed pressure within a single-stage stabilizer over time during and after discharge, a narrow, high pressure peak would be observed. On the other hand, the multistage expansion chamber of the present invention is believed to exhibit a lower amplitude pressure pulse over a longer duration, resulting in a smoother curve. The duration of the pressure pulse within the multistage muzzle stabilizer 10 more closely matches that of the recoil and reload cycle of the firearm. Thus, the muzzle stabilizer of the present invention, with a multistage expansion chamber, provides corrective force that more closely matches, and thereby balances, the duration and magnitude of the recoil pulse.

The multistage expansion chamber can have three or more stages. Embodiments of the present invention with three or more expansion stages can be used with high muzzle energy rounds, such as 7.62 mm NATO, 7.62 mm×54R, or .50 caliber BMG rounds. The addition of third, fourth or more stages further flattens the pressure pulse curve after each round is discharged, which may be desirable for such high power rounds. The additional stages can be provided by incorporating one or more intermediate stages (not shown) between the tubular body 12 and the attachment flange 14, where the intermediate stage has an inner diameter between those of the tubular body 12 and attachment flange 14. Like the attachment flange, the intermediate stage can be detachable from the tubular body 12, or can be formed of unitary construction with the tubular body 12. The exact lengths and diameters of the three or more stages can be optimized through field trials by one skilled in the art.

In one embodiment of the invention, the muzzle stabilizer can be distributed with additional elements in a kit. Among the desirable components that can be included in the kit include an allen wrench (not shown) for turning the set screws 30, extra set screws, and lock washers or sealing rings (not shown) to form a seal between the attachment flange 14 and the end of the unthreaded portion of the firearm muzzle.

Figure 7:
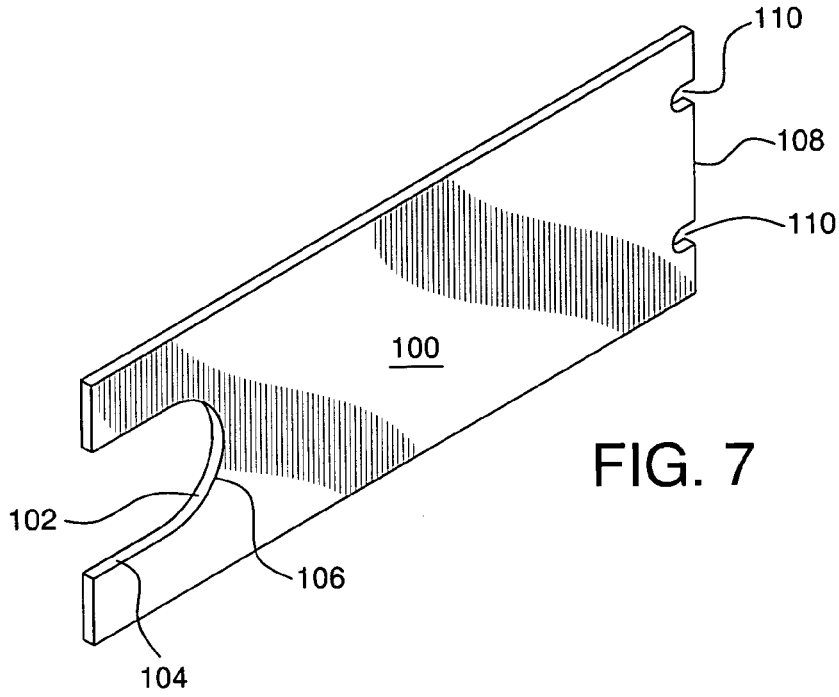
FIG. 7 is an isometric view of an adjusting tool according to a kit embodiment of the present invention.
Figure 8:
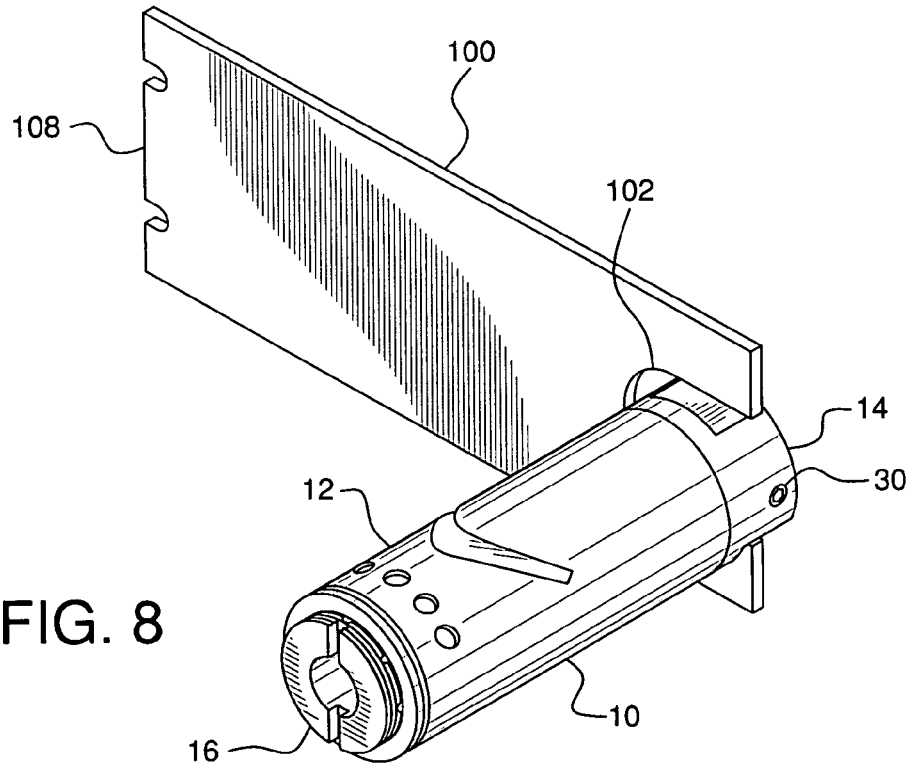
FIG. 8 is a view of the adjusting tool of FIG. 7 engaged with the muzzle stabilizer of FIG. 1 in a first adjusting fashion.

The kit can also be provided with an adjusting tool 100, of which a preferred embodiment is shown in FIG. 7. The tool 100 has two means for adjusting the muzzle stabilizer 10. A first end of the tool 100 includes a rotational adjustment surface 102 with straight wrenching surfaces 104 adapted to engage flats 28 of the attaching collar 24. The rotational adjustment surface 102 further includes an arc portion 106 for engaging the curved body of the attaching collar 24. A second end of the tool 100 includes a gas regulator adjusting surface 108. The surface 108 is of the appropriate width to engage driving slot 36 in order to turn the gas regulator 16 relative to the body 12. If, for the sake of rigidity or integrity, the width of tool 100 is greater than that of the slot 36, the surface 108 can be tapered to an appropriate width for engaging the slot 36. Adjacent the gas regulator adjustment surface 108 are a pair of slots 110 adapted to receive the edge of the body 12, such that the degree of insertion of the gas regulator 16 into the body 12 is not limited.

Having described the structure of the muzzle stabilizer 10 of the present invention and the specific dimensions and configuration of one test model, the function of the muzzle stabilizer 10 will now be more fully explained. As has already been noted, the muzzle stabilizer 10 functions to exert a counterbalancing or correcting force on the muzzle of the firearm. Without the muzzle stabilizer 10, the firearm has a tendency to climb vertically and also deviate laterally to the right or left, depending on the individual body mechanics of the user, as or after a projectile is discharged. The magnitude of climb and the direction and magnitude of lateral deviation is different for every individual user of the firearm, depending on the individual body mechanics. The amount of climb and deviation for each discharge is multiplied by the number of rounds discharged during a period of rapid automatic firing. Thus, without the muzzle stabilizer 10, a firing pattern will tend to form a roughly linear path starting at or near the target (the starting point depending, of course, on the accuracy of the user) and propagating up and to the right or left, moving further from the target as the firing period continues.

In use, the assembled muzzle stabilizer 10 is threaded onto the threads of the end of a firearm muzzle 200 (or otherwise coupled in accordance with the coupler on the end of the muzzle) as shown in FIG. 6. Rotational adjustment can be achieved by using the tool 100 to turn the muzzle stabilizer 10 with respect to the muzzle 200. It is also possible to rotate the muzzle stabilizer 10 using a wrench or by hand. Whatever means are used, rotation of the muzzle stabilizer 10 allows the gas vents 18, 20 to be oriented at an infinitely selectable angle with respect the vertical plane of many firearms. (Some firearms permit attachment only at discrete angular positions.) This adjustment dictates the direction of the corrective force that the muzzle stabilizer exerts as or immediately after a projectile is discharged. By using this first means of adjusting the muzzle stabilizer, the direction of corrective force can be very closely matched, and subsequently fine tuned, to counter the direction of climb (combination of vertical climb and lateral deviation) experienced by the individual user. For example, it may be found that an individual user experiences an uncorrected discharge pattern that propagates at 50 degrees off the vertical axis of the firearm. In that case, the center of the gas vents can be oriented at 50 degrees off the vertical axis to direct gases from the discharge of the rounds in a pattern of the same average vector to produce an opposite reactive force. Once the appropriate rotational position of the gas vents 18, 20 is established, the set screw 30 can be tightened to lock the muzzle stabilizer 10 relative to the muzzle 200.

Figure 9:
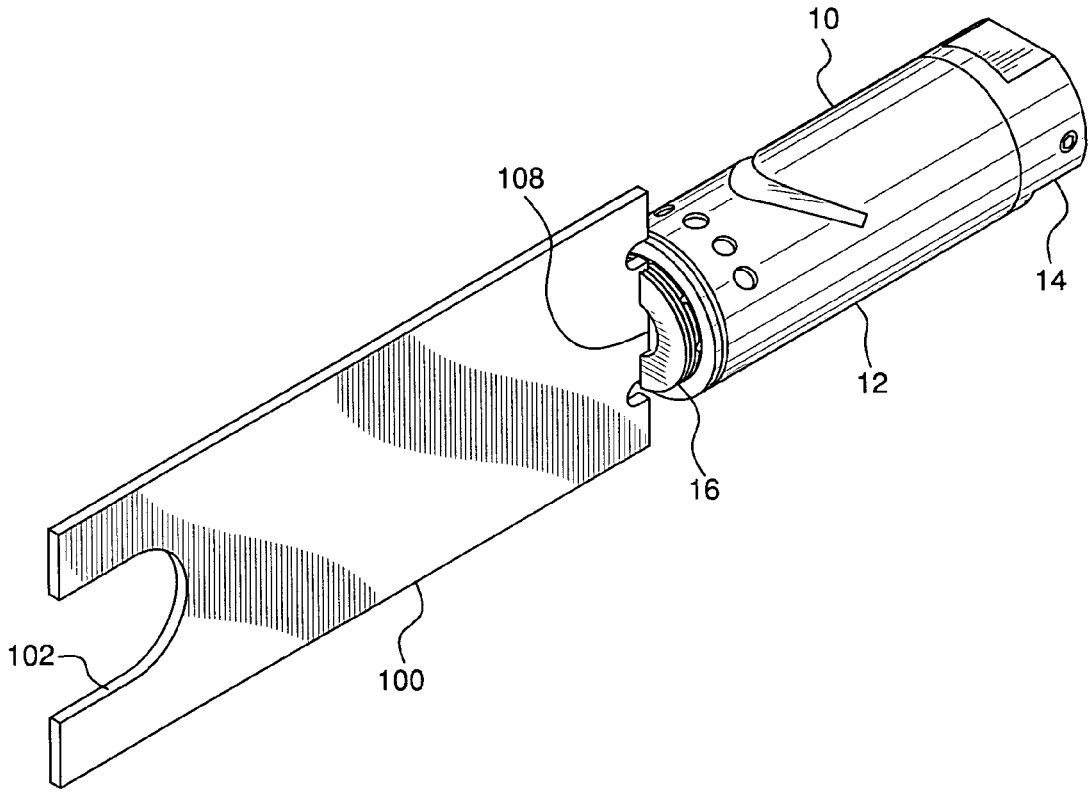
FIG. 9 is a view of the adjusting tool of FIG. 7 engaged with the muzzle stabilizer of FIG. 1 in a second adjusting fashion.

The magnitude of the corrective force can be adjusted by changing the degree of insertion of the gas regulator 16 into the body 12. This adjustment can be performed using surface 108 of the tool 100 as shown in FIG. 9, or, if the tool 100 is not available, using a screwdriver, an appropriately sized coin, or any other object with a suitable surface. As the gas regulator 16 is turned, the index grooves 38 incrementally engage the spring detent 42 to provide stop points for the adjustment. The stopping power of the incremental engagement of the spring detent 42 with the index grooves 38 is adequate to prevent rotation of the gas regulator 16 with respect to the body 12 under normal firearm operating conditions. However, the gas regulator 16 can be easily turned with the aid of the tool 100 or other convenient driving device.

With reference again to FIG. 5, it can be seen that the rotation of gas regulator 16 adjusts the magnitude of the counterbalancing force exerted by gases that are vented from the muzzle stabilizer 10. As previously mentioned, gases generated during discharge of a round seek the path of least resistance in exiting the muzzle of the firearm. When the gas regulator 16 is in a relatively withdrawn position, the ninety-degree vents are freely accessible as egress routes for venting gas. Moreover, it is believed that the conical surface 34 of the gas regulator 16 acts as a guide to direct gas through the ninety-degree vents. (To the degree that the complex fluid dynamics within the muzzle stabilizer 10 during and after discharge are not completely described herein, the specific dynamics described herein are in no way meant to limit the scope of the present invention, but rather to illustrate the principle of operation.)

When the gas regulator 16 is turned and inserted further into the body 12, the egress path to the ninety-degree vents becomes more constricted, thereby lessening the amount and force of the gas venting through the ninety-degree vents. Instead, more gas will vent through the thirty-degree vent, which venting provides only a fraction of the force of ninety-degree venting in the corrective direction (the direction having been established using the first adjustment means described above). On average, it is believed that each unit of gas, and associated energy, vented through the thirty-degree vent provides approximately 50 percent of the force in the corrective direction that is generated by a unit vented through the ninety-degree vent. (In general, the magnitude of a force vector shifted from ninety degrees to thirty degrees is the sin of 30 degrees, which is 0.5.) This figure is only a rough approximation, because it does not take several factors into account, such as the interaction of the venting gas with the conical section 34, any increase in forward venting through the discharge orifice 35, and variations in actual exerted forces due to the shape of the thirty-degree vent and graduated ninety-degree vents. In practice, no mathematical calculations are needed to adjust the gas regulator 16. Instead, it is preferred that the gas regulator be adjusted through a series of round discharge trials shot by the individual user.

As the gas regulator 16 is inserted still further into the body 12, the cylindrical portion 32 can begin to obstruct the ninety-degree vents 18, thereby even further reducing or preventing gas venting through the ninety-degree vents 18 and increasing venting through the thirty-degree vent 20 and exit orifice 35. When the gas regulator 16 is fully inserted, a minimum magnitude of corrective force is provided.

When the appropriate direction and magnitude of the corrective force have been set, the muzzle stabilizer is fully adjusted, although further fine tuning is almost always possible. As a projectile is discharged, the gas produced passes from the muzzle through the multistage expansion chamber. Because the stages of the expansion chamber increase in diameter from the attachment flange to the gas regulator, the gas continuously expands as it passes from the muzzle through the stages of the expansion chamber. (Continuous expansion does not necessarily mean expansion at a perfectly regular or linear rate, but rather means that the gas expands as it passes through the multistage chamber, without again contracting within the chamber. Of course, some contraction of the gas may occur as it is vented through the gas vents.) Thus, the flow of gas through the muzzle stabilizer can be finely tuned to produce a pressure pulse having a duration that closely matches that of the recoil of the firearm, even when high-power rounds are used. The muzzle stabilizer of the present invention provides corrective force that closely matches, and thereby balances, the duration and magnitude of the recoil pulse, alleviating the problem of muzzle climb.

As noted above, a variety of modifications to the embodiments described will be apparent to those skilled in the art from the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A muzzle stabilizer for a rapid-fire repeating firearm comprising:

a tubular body comprising two or more gas vents, wherein a first gas vent, nearest to a first end of the tubular body, has an angle that is perpendicular to a longitudinal axis of the tubular body, and a second gas vent, nearest to a second end of the tubular body, has an angle that is non-parallel to the angle of the first gas vent;

an attachment flange connected to the second end of the tubular body, the attachment flange having a coupler adapted to mate with a corresponding coupler on the end of the muzzle of the firearm;

a gas regulator threadedly engaged with the first end of the tubular body such that rotation of the gas regulator adjusts the venting of gas through at least one of the two or more gas vents, the threaded engagement of the gas regulator and tubular body comprising a thread pattern of 28 or more threads per inch; and a spring indent biased into the interior of the tubular body, wherein the gas regulator comprises six or more circumferentially arranged index grooves for incrementally engaging the spring indent.

2. A muzzle stabilizer adapted to be attached to the end of a rapid-fire repeating firearm muzzle, the muzzle stabilizer comprising:

a tubular body having an inner diameter and a plurality of gas vents, wherein a first gas vent, nearest a first end of the tubular body, has an angle that is perpendicular to a longitudinal axis of the tubular body, and a second gas vent, nearest a second end of the tubular body, has an angle that is non-parallel to the angle of the first gas vent;

an attachment flange connected to the second end of the tubular body, the attachment flange having a coupler corresponding with a coupler on the end of the muzzle and an inner diameter different from that of the tubular body;

the inner diameter of the attachment flange defining a first expansion chamber stage and the inner diameter of the tubular body defining a second expansion chamber stage, wherein gas produced during discharge of a projectile will expand as it travels from the muzzle through the first and second stages; and a gas regulator adjustably engaged with the first end of the tubular body for regulating the venting of gas through at least one of the plurality of gas vents, wherein the first gas vent comprises a plurality of openings of graduated sizes radially arranged about the tubular body.

3. A muzzle stabilizer adapted to be attached to the end of a rapid-fire repeating firearm muzzle, the muzzle stabilizer comprising:

a tubular body comprising gas vents of graduated sizes radially arranged about the tubular body and at least one slot gas vent, wherein the gas vents of graduated sizes are nearest to a first end of the tubular body and have an angle that is perpendicular to a longitudinal axis of the tubular body, and said at least one slot gas vent is nearest to a second end of the tubular body and has an angle that is non-parallel to the angle of the gas vents of graduated sizes;

an attachment flange at the second end of the tubular body, the attachment flange having a coupler adapted to mate with a corresponding coupler on the end of the muzzle;

a gas regulator threadedly engaged with the first end of the tubular body such that rotation of the gas regulator adjusts the venting of gas through at least one of the gas vents of graduated sizes and said at least one slot gas vent.

4. The muzzle stabilizer of claim 3 wherein the radially arranged gas vents are disposed at an angle of ninety degrees with respect to the longitudinal axis of the tubular body.

5. The muzzle stabilizer of claim 4 wherein the angle of said at least one slot gas vent is thirty degrees with respect to the longitudinal axis of the tubular body.

6. The muzzle stabilizer of claim 3 wherein the attachment flange is removably attached to the tubular body.

7. The muzzle stabilizer of claim 3 wherein the tubular body and the attachment flange have different internal diameters, the internal diameter of the attachment flange defining a first expansion chamber stage and the internal diameter of the tubular body defining a second expansion chamber stage.

8. The muzzle stabilizer of claim 3 further comprising a multistage expansion chamber.

9. A muzzle stabilizer kit comprising:

a muzzle stabilizer for a rapid-fire repeating firearm, the muzzle stabilizer comprising:

a tubular body comprising two or more gas vents, wherein a first gas vent, nearest to a first end of the tubular body, has an angle that is perpendicular to a longitudinal axis of the tubular body, and a second gas vent, nearest to a second end of the tubular body, has an angle that is non-parallel to the angle of the first gas vent, an attachment flange connected to the second end of the tubular body, the attachment flange having an adjustment surface and a coupler adapted to mate with a corresponding coupler on the end of the muzzle of the firearm, and a gas regulator threadedly engaged with the first end of the tubular body, the gas regulator having a driving surface for effecting rotation of the gas regulator relative to the tubular body, said rotation adjusting the venting of gas through at least one of the two or more gas vents; and an adjusting tool comprising a rotational adjustment surface adapted to engage the adjustment surface of the attachment flange and a gas regulator adjusting surface adapted to engage the driving surface of the gas regulator, wherein the first gas vent comprises a plurality of openings of graduated sizes radially arranged about the tubular body.

10. The kit of claim 9 wherein the radially arranged openings are disposed at a ninety degree angle from the longitudinal axis of the tubular body and the second gas vent is disposed at a thirty-degree angle from the longitudinal axis.

* * * * *